US005272989A

United States Patent [19]

Johnston et al.

[11] Patent Number: 5,272,989

[45] Date of Patent: Dec. 28, 1993

[54] FIBERBOARD PALLET

[75] Inventors: Robert E. Johnston, Lake Zurich, Ill.; Richard P. Wade, Anchorage, Ky.

[73] Assignee: Weyerhaeuser Company, Tacoma, Wash.

[21] Appl. No.: 818,070

[22] Filed: Jan. 8, 1992

[51] Int. Cl.[5] ..... B65D 19/00

[52] U.S. Cl. ..... 108/51.3

[58] Field of Search ..... 108/51.1, 51.3

[56] References Cited

U.S. PATENT DOCUMENTS

| | | | |
|---|---|---|---|
| 3,659,534 | 5/1972 | Childs | 108/51.3 |
| 3,952,672 | 4/1976 | Gordon et al. | 108/51.3 |
| 4,185,565 | 1/1980 | Nymoen | 108/51.3 |
| 4,759,295 | 7/1988 | Nilsen et al. | 108/51.3 |

FOREIGN PATENT DOCUMENTS

| | | | |
|---|---|---|---|
| 569101 | 1/1959 | Canada | 108/51.3 |
| 928141 | 6/1963 | United Kingdom | 108/51.3 |
| 996516 | 6/1965 | United Kingdom | 108/51.3 |

*Primary Examiner*—Peter M. Cuomo
*Assistant Examiner*—Michael J. Milano
*Attorney, Agent, or Firm*—Notaro & Michalos

[57] ABSTRACT

A fiberboard pallet comprises a deck of multi-wall corrugated fiberboard having a lower surface to which three, four or more elongated legs are permanently attached, for example, by gluing. Each leg is formed of a die cut blank having a series of five panels which are folded into a quadrilateral shape to form an initially open elongated passage. End flaps at the ends of each leg are folded and overlap each other to close the ends. At least two side openings are formed in each leg and any communication into the passage of the quadrilateral shape is closed by closing flaps formed as one piece with side panels of each leg.

26 Claims, 5 Drawing Sheets

FIBERBOARD PALLET

FIELD AND BACKGROUND OF THE INVENTION

The present invention relates in general to pallet construction, and in particular to a new and useful four-way entry pallet made of fiberboard and constructed so that it can be manufactured using automated equipment for cutting blanks to construct the pallet and folding and assembling the blanks into the pallet.

FIGS. 5 and 6 illustrate a fiberboard pallet which has been shipped to the United States for supporting automotive parts.

This known pallet construction comprises a deck part 100 which is formed from an elongated blank having a pair of opposite end portions 102 which are folded into the form of rectangular elongated legs on opposite ends of the pallet. An intermediate leg 104 is made from a separate blank and folded into the elongated central leg. The opposite ends of each leg 102 and 104 are open and must be closed by U-shaped inserts 106 which are glued into place in the open ends of the legs. Staples 108 and glue (not shown) are used to fix the end legs 102 into their rectangular shape, and also to secure the intermediate leg 104 to the deck part 100. A pair of passages 110 are provided through each of the end legs 102 and through the intermediate leg 104 (although this is not visible in FIG. 5). Each passage 110 has opposite ends which are closed by multi-panel flaps 112 which form flat facing areas 114 in a respective passage 110.

Primarily because the one piece construction of deck portion 100 with its end legs 102 as shown in FIG. 6, and the need for inserts 106, the manufacture of the pallet of FIG. 5 cannot be automated. Each pallet is assembled by hand which adds significantly to its cost.

As shown in FIG. 6, each leg 102 comprises four panels **102*a*, 102*b*, 102*c* and 102*d*, which are folded into the rectangular cross section for each leg shown in FIG. 5**.

The closing flaps 112 each comprise two panels, one of which forming the facing area 114. The inserts 106 are cut from openings 107 in each of the panels **102*a*. Flaps 112 are cut into panels 102*c* to form an opening that aligns with the opening 107 and forms the through-passage in each of the legs 102. The intermediate leg 104 is constructed in substantially the same way as each of the end legs 102, but with one extra elongated panel (not shown) for closing the rectangular cross section of leg 104**.

Other fiberboard pallet designs are also known.

U.S. Pat. No. 4,875,419 discloses a collapsible paperboard pallet. The pallet is formed completely of fiberboard having a plurality of tabs that are folded inwardly in order to accommodate a forklift. This pallet having both a top and a bottom with all four sides does not have any legs per se but through a series of folded tabs accommodates the forklift.

U.S. Pat. No. 3,911,834 also discloses a pallet made of foldable material such as corrugated paperboard. The construction of the pallet consists of one sheet of paperboard that is folded in a manner such that the pallet has two distinct legs and a top. Due to pre-arranged slits in the fiberboard section, the legs become capable of receiving the forks of a forklift when the slits are folded back.

U.S Pat. No. 4,864,940 for a collapsible pallet discloses pallet structure that is collapsible into a V-shaped configuration. In its final configuration the collapsible pallet has two rectangular open sections cut out at each side so that a forklift may be received.

U.S. Pat. No. 4,378,743 discloses a paperboard pallet having interlocked runners. This pallet is constructed of a foldable material such as corrugated fiberboard and is provided with a series of apertures capable of receiving pre-formed supporting blocks or legs that serve as runners for the pallet. The runners are inserted into the pre-arranged slots of the paperboard and are locked into place and capable of bearing a load.

U.S. Pat. No. 4,863,024 discloses a pallet and related products made of an elongated continuous sheet of corrugated material that is folded and used in conjunction with support beams that are inserted into pre-arranged cutouts in the paperboard. The beams used in conjunction with the folded configuration give the pallet strength and its capability of supporting a load.

U.S. Pat. No. 4,100,859 discloses a forklift pallet that is a disposable pallet which utilizes vertical and horizontal tubular supports.

A need remains for a fiberboard pallet which can be manufactured inexpensively using automation and using a relatively few number of parts which, nevertheless, produces a rugged reuseable pallet having a four-way entry capacity for forklifts.

SUMMARY OF THE INVENTION

An object of the present invention is to provide a reusable inexpensive pallet made virtually entirely from corrugated fiberboard which include blanks which are die cut, folded and glued using automated machinery.

A further object of the invention is to provide a fiberboard pallet which allows four-way entry and which can be constructed using various strength corrugated fiberboard blanks to meet various application requirements. The pallet of the invention is completely recyclable thereby contributing to resource conservation. The pallet design reduces problems created by disposable wood pallets which require much more space in refuse containers and landfills. The fiberboard pallet of the invention is lighter in weight than wood pallets having similar size which reduces freight cost. The lighter weight also reduces the risk of back injury caused by heavier wood pallets.

Accordingly a further object of the present invention is to provide a fiberboard pallet comprising: a deck including a multi-wall corrugated fiberboard deck panel having opposite side edges, opposite end edges connected between said side edges, an upper surface and a lower surface; a plurality of elongated legs fixed to the lower surface of the deck panel, at least two of the legs extending along and being adjacent respective opposite end edges of the deck panel; each leg comprising five panels connected by fold lines to each other in series, the five panels being formed at the fold lines into an initially open-ended quadrilateral shape having a passage therethrough, one panel at one end of the series lapping another panel at an opposite end of the series, a pair of outer end flaps, connected at fold lines to outer ends of one of said five panels, a pair of inner end flaps connected at fold lines to opposite ends of another one of said five panels, said inner end flaps being folded over respective ends of said open-ended quadrilateral shape, and said outer end flaps being folded over and fixed to said inner end flaps to close outer ends of the passage, two of said panels comprising side panels each having at least one side opening therethrough, said side openings being aligned in the quadrilateral shape, at least one of the side panels including a passage closing flap separated from the side opening of the side panel by score lines and connected to the side panel by at least one fold line, the passage closing flap being foldable into a position for closing the passage of the quadrilateral shape, adjacent the aligned side openings.

A further object of the present invention is to provide a multi-wall, corrugated fiberboard panel which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 4:
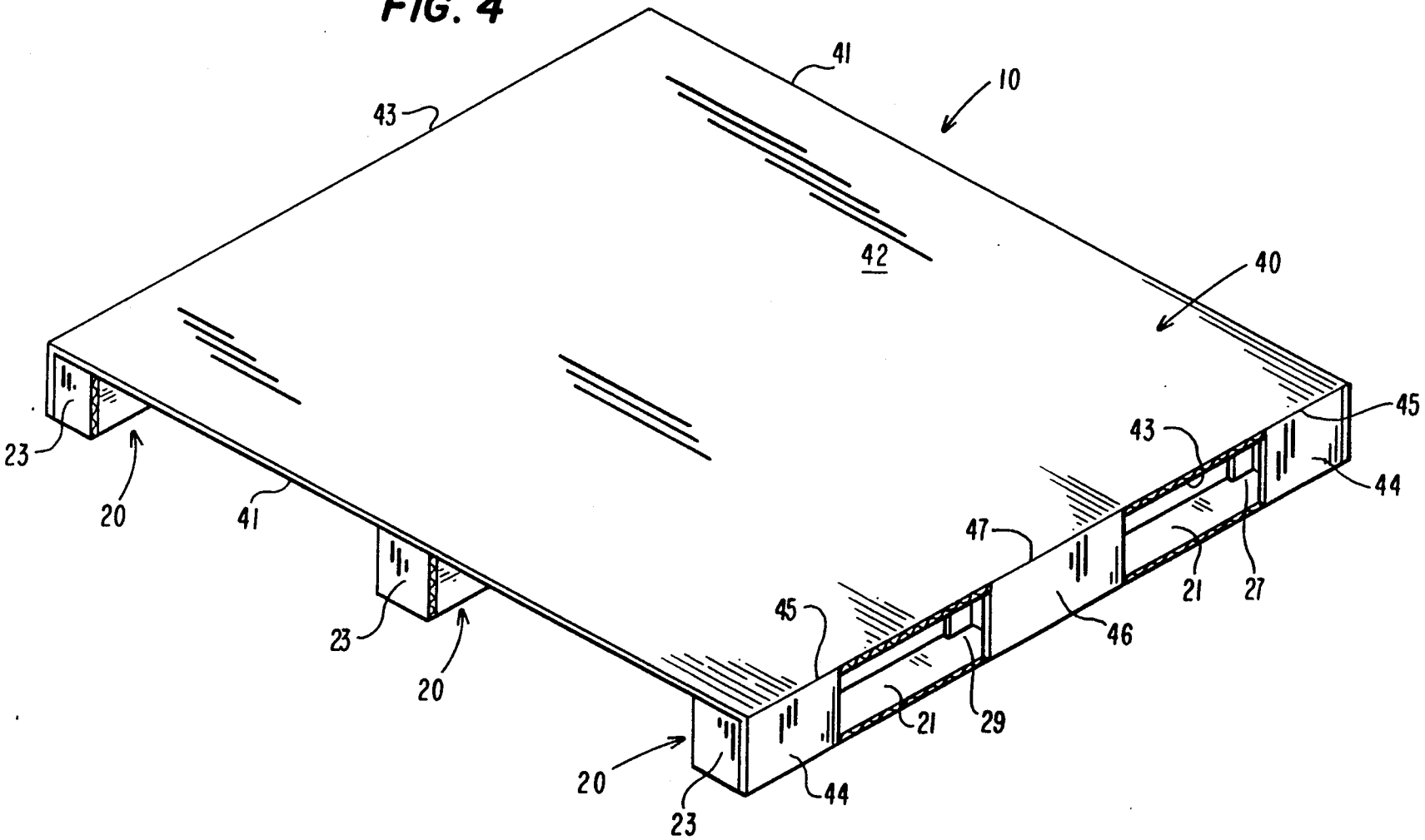
FIG. 4 is a perspective view of the fiberboard pallet constructed in accordance with the present invention.
Figure 5:
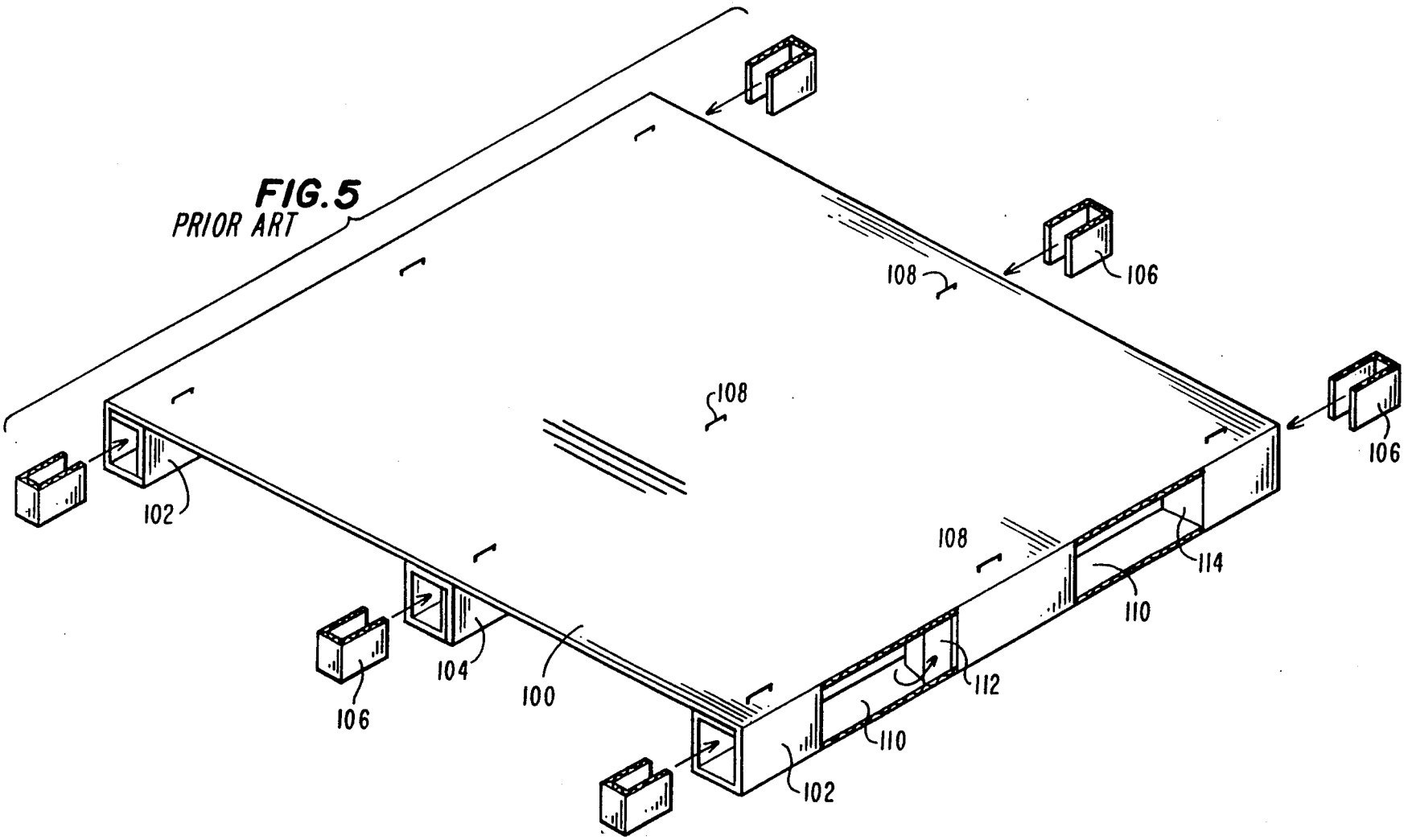
FIG. 5 PRIOR ART
FIG. 5 is a perspective exploded view of a fiberboard pallet constructed according to the prior art.
Figure 6:
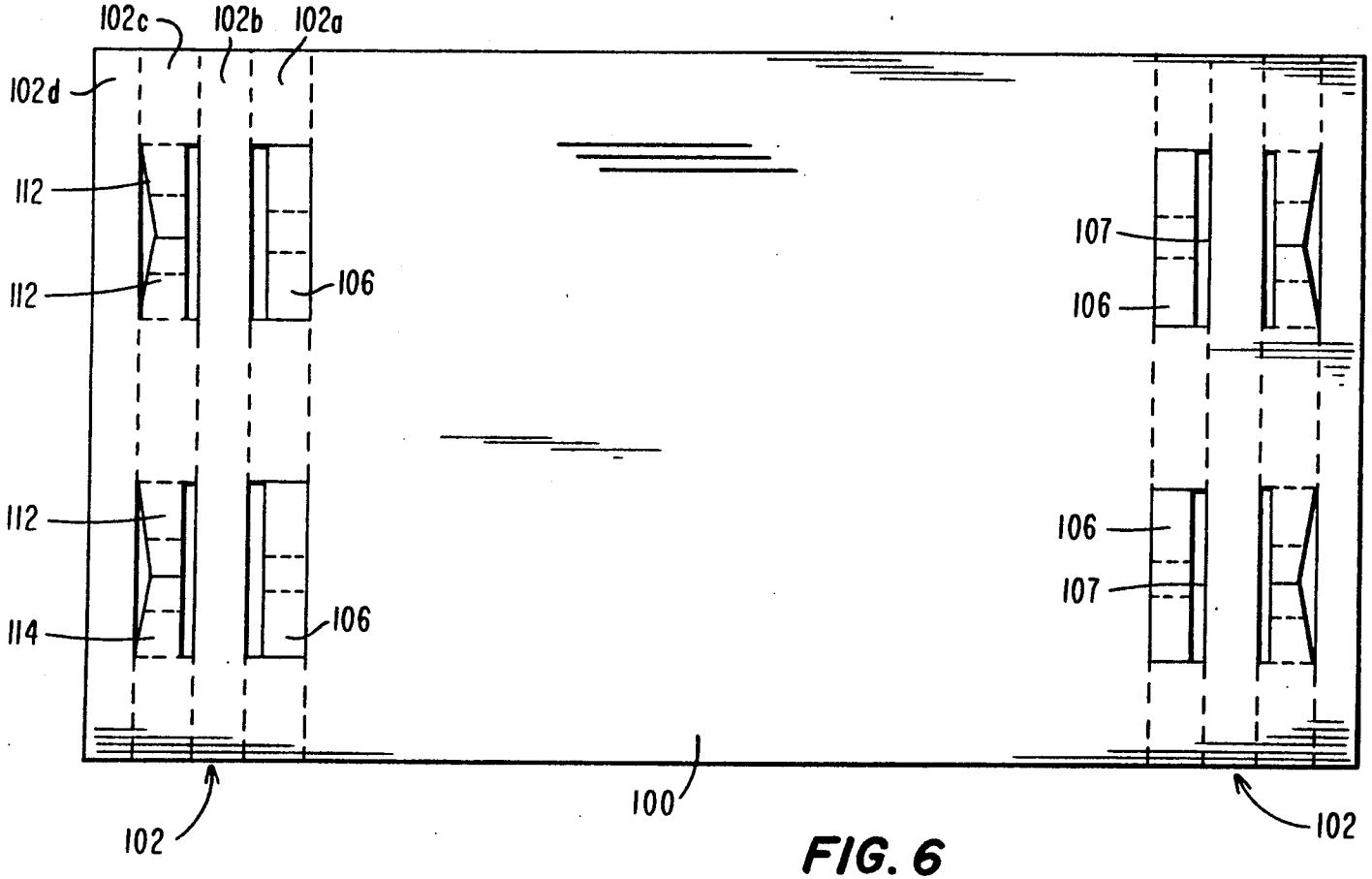
FIG. 6 PRIOR ART
FIG. 6 is a top plan view of a blank used to make the deck and end legs of the pallet shown in FIG. 5.

Referring to the drawings in particular, the invention embodied therein comprises a multi-wall, corrugated fiberboard pallet generally designated 10 in FIG. 4 which comprises a deck 40 having opposite side edges 41, 41, opposite end edges 43, 43 connected between the side edges, an upper surface visible in FIG. 4, and a lower surface. A plurality of elongated legs generally designated 20 are fixed, for example by industrial glue to the bottom surface of the deck 40. At least two of the legs extend along and are adjacent the respective opposite end edges 43, to form ends of the pallet. In addition, one intermediate leg which extends parallel to the end legs, is positioned between the end legs, under the middle of the deck. Alternatively, two or more spaced apart intermediate legs can be provided. In either case at least two fork lift entry passages are defined between the legs at the side edges 41, 41. Each leg 20 also includes at least one but preferable two side openings 21, 21 for receiving forklift forks and for completing the four-way entry feature of the pallet 10.

Figure 3A:
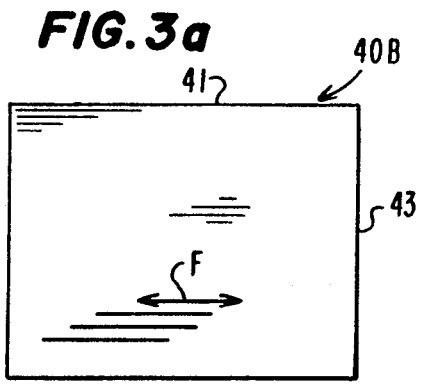
FIG. 3*a* is a top plan view of an alternate deck blank in accordance with the present invention.
Figure 3:
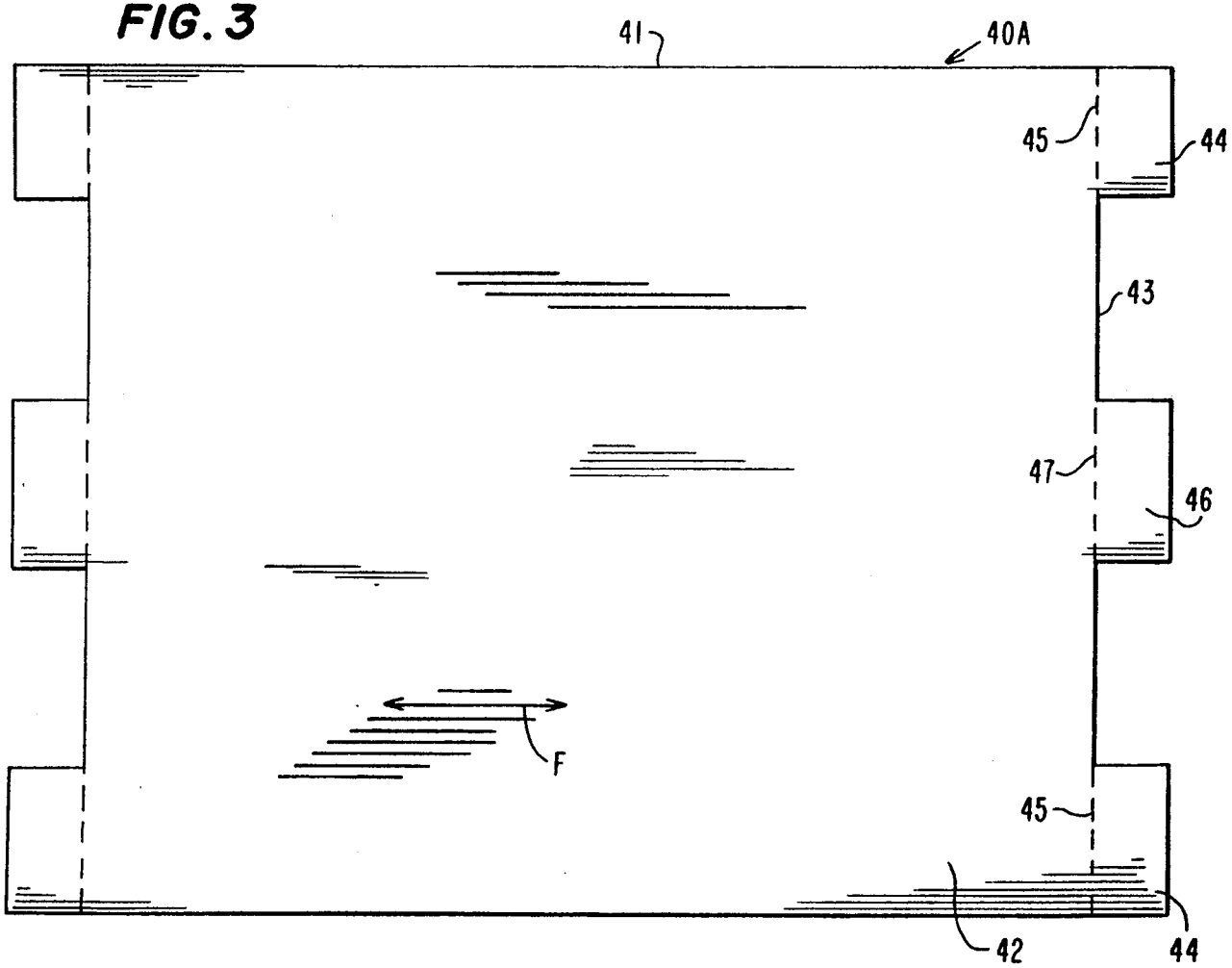
FIG. 3 is a top plan view of a multi-wall fiberboard blank for constructing a deck of the present invention.

Referring to FIG. 3, deck 40 is constructed from a deck blank 40A which comprises a deck panel 40 constructed of multi-wall corrugated fiberboard. Depending on the intended use of the pallet, the deck may be either A-A flute, A-C flute or B-C flute, double wall (850 or 1000) or any combination of A or B or C flute, or A-A-A, C-A-A or B-C-A flute triple wall of various grades or any combination of A or B or C flutes. The flute direction of the multiple layers should cross each other from one layer to the next, for added strength.

For an even stronger deck, two or more double wall corrugated blanks can be laminated to each other. Any other combination of single, double or triple wall blanks may also be used as the deck material. Although the deck can be constructed of a rectangular or square deck panel 42 alone, it is also advantageous to provide the deck blank with a pair of end flaps 44 connected at fold lines 45 to the deck panel 42, and an intermediate flap 46 connected at fold line 47 to the deck panel. The three flaps 44, 46, 44 are attached by the fold lines to each end edge 43 and are dimensioned to span the spaces between the side openings 21 in the legs.

As shown in FIG. 3, the flutes of the deck blank 40B extend in the direction F, between the end edges 43, and parallel to the side edges 41.

FIG. 3*a* shows, on a reduced scale an alternate deck blank 40B, having the same side and end edges 41, 43 as in the embodiment of FIG. 3, but with no flaps. This is an alternate embodiment for the deck of the inventive pallet.

Figure 1:
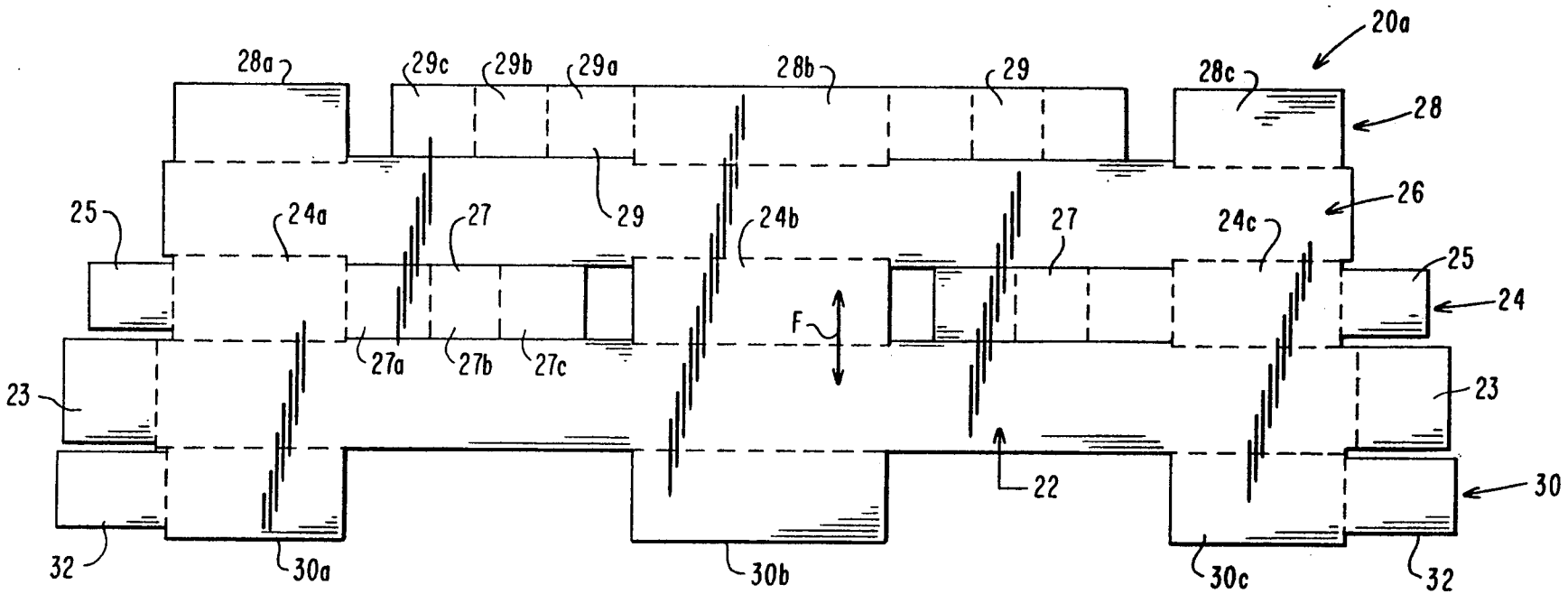
FIG. 1 is a plan view of a corrugated fiberboard blank for use in constructing an elongated leg of the present invention.

FIG. 1 illustrates a fiberboard blank used to construct each of the elongated legs 20. Blank 20A comprises a die cut piece of multi-wall corrugated fiberboard which may for example be A-A flute or any combination of A, B or C flute. The most common paper components for this blank are 96-33-38-33-96 corrugated fiberboard. The flutes extend transversely to the long dimension of the blank, as shown at F in FIG. 1.

The strength of the leg can be varied by changing the paper composition, for example utilizing 96-33-69-33-96 product, 69-33-38-33-69 product or 42-33-42-33-42 product. While the legs are typically double wall, single wall corrugated fiberboard may also be used. Each of the foregoing numbers designates a paper weight in pounds per thousand square feet. For example the heavy weight paper 96 is measured as being 96 pounds per thousand square feet of paper product.

Leg blank 20A comprises five panels connected to each other in series at fold or score lines, which can be folded into an initially open-ended quadrilateral shape having a passage therethrough, with one panel at one end of the series, for example, a lapping panel 30, lapping over or under a panel at the opposite end of the series, for example a side panel 28.

In the embodiment illustrated in FIG. 1, a bottom panel 22 is connected at fold lines shown as dash lines, to the lapping panel 30. Lapping panel 30 actually comprises opposite end panel portions 30*a* and 30*c* and an intermediate 30*b*.

A first side panel 24 is connected by fold lines to an opposite side of the bottom panel 22. A top panel 26 is connected by fold lines to an opposite side of the first side panel 24 and the panel 28, forming a second side panel, is connected by fold lines to the top panel 26.

Figure 2:
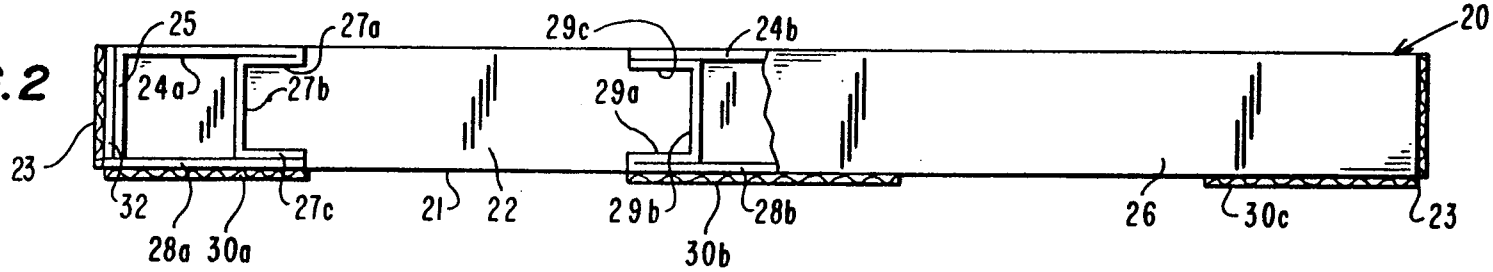
FIG. 2 is a top plan view, partly in section of the leg in its assembled condition.

Each of the side panels 24 and 28 include at least one and preferable two side openings therethrough which in the quadrilateral shape depicted in FIG. 2, are aligned and form the side openings 21.

A pair of score lines in each opening of the first side panel 24 (score lines being depicted as solid lines) separate a pair of outer passage closing flaps 27 from the first side panel 24. Each outer end closing flap 27 is connected by a fold line to the side panel and includes two additional fold lines to divide the flap into a connected flap portion 27a, an intermediate flap portion 27b and a free flap portion 27c.

A similarly formed inner passage closing flap 29 is separated from each side opening in the second side panel 28, by a score line. Each inner passage closing flap 29 includes fold lines which separate the flap into a connected flap portion 29a, an intermediate flap portion 29b and a free flap portion 29c.

As shown in FIG. 2, when the blank is folded into the quadrilateral shape, the three parts of the lappin panel 30 are glued to the outer surfaces of respective side panel portions 28a, 28b and 28c.

Any communication between the side openings 21, and the passage through the quadrilateral shape, is closed by folding the outer passage closing flaps 27 and the inner passage closing flaps 29 in the manner shown in FIG. 2. To this end, connected flap portions 27a and 29a are bent 180 degrees and engaged or glued to inner surfaces of the respective panel portions 24a and 28b.

The intermediate panel portions 27b and 29b span the passage through the leg to close the passage. Each free flap portion 27c and 29c is glued to inner surfaces of the panel portions 28a and 24b, to complete the passage closure. The panel portions are dimensioned for properly closing the passage. An alternate embodiment of the invention (not shown) allow the connected flap portions 27a and 29a to span the passage width through the leg, with the intermediate and free flaps line parallel to each other and being glued to the inner surfaces of the respective panel portions 28a and 24b.

The open ends of the passage through the leg is closed by end flaps attached to at least two, but preferably three panels of the leg blank. More than three end flaps may also be used to close each end of the passage. In the preferred embodiment, a pair of outer end flaps 23, 23 are connected to the outer ends of the bottom panel 22, by score lines. A pair of intermediate end flaps 32, 32 are connected by score lines to opposite ends of the lapping panel 30 and an inner pair of flaps 25, 25 are connected by score lines to the opposite ends of the first side panel 24. The score lines of the respective outer (23), intermediate (32) and inner (25) end flaps are progressively closer to the center of the leg so that when the end flaps are folded and overlap each other, they take up their inner, intermediate and outer positions for providing at least a triple layer of corrugated fiberboard at the outer end of each leg. This both provides a strong closure to the end of the leg and vertical supporting strength in this area of the pallet. In likewise fashion, bending the closing flaps 27 and 29 into the U-shaped shown in FIG. 2, provides column strength to the panel. The transverse orientation of the flute directions F, F in the deck and leg blanks also increases the strength of the pallet, and the vertical supporting strength of the legs. This is further increased by bending the deck end flaps 44, 46 and 44 down over the outer surfaces of panel portions 30a, 30b and 30c. Alternatively, outer surfaces of the first side panel 24 at portions 24a, 24b and 24c are covered by the deck flaps 44, 46 and 44. Appropriately, hot melt or any other type of glue may be utilized to attach all facing surfaces of the blank and blank portions to produce a very strong reuseable product which can be recycled, which is light and which has many advantages over conventional wood pallets.

Terms like "bottom" and "top" are meant to be used interchangeably. Although preferably the top panel 26 is glued to the bottom surface of the deck, the invention works equally well if the bottom panel 22 is glued to the deck. The position of the inner and outer closing flaps 27 and 29 can also be interchanged, that is with the outer closing flaps 27 on the second side panel 28 and the inner closing flaps 29 on the first side panel 24. The widths of each of the leg panels is also selected to form a square cross section for the quadrilateral shape. Care must be taken to position the score lines appropriately, to take into account the material thickness of each panel. Alternatively, a rectangular cross section may be provided by increasing or decreasing the relative widths of the top and bottom panels compared to the side panels. The term "quadrilateral" is meant to include both a square and a non-square cross sectional shape for the legs.

While a specific embodiment of the invention has been shown and described in detail to illustrate the application of the principles of the invention, it will be understood that the invention may be embodied otherwise without departing from such principles.

What is claimed is:

1. A fiberboard pallet comprising:

a deck including a multi-wall corrugated fiberboard deck panel having opposite side edges, opposite end edges connected between said side edges, an upper surface and a lower surface;

a plurality of elongated legs fixed to the lower surface of the deck panel, at least two of the legs extending along and being adjacent respective opposite end edges of the deck panel; and each leg comprising five panels connected by fold lines to each other in series, the five panels being formed at the fold lines into an initially open-ended quadrilateral shape having a passage therethrough, one panel at one end of the series lapping another panel at an opposite end of the series, a pair of opposite outer end flaps, connected at fold lines to outer ends of one of said five panels, a pair of inner end flaps connected at fold lines to opposite outer ends of another one said five panels, said inner end flaps being folded over respective ends of said open-ended quadrilateral shape, and said outer end flaps being folded over and fixed to said inner end flaps to close outer ends of the passage, two of said panels comprising side panels each having at least one side opening therethrough, said side openings being aligned in the quadrilateral shape, at least one of the side panels including a passage closing flap separated from the side opening of the side panel by score lines and connected to the side panel by at least one fold line, the passage closing flap being foldable into a position for closing the passage of the quadrilateral shape, adjacent the aligned side openings.

2. A pallet according to claim 1, including at least one flap connected by a fold line to each end edge of the deck panel, each flap of the deck panel being folded onto and fixed to a panel of one of the legs at the end edges of the deck panel.

3. A pallet according to claim 1, wherein the deck panel includes corrugated flutes extending parallel to one of the side and end edges, the five panels forming each leg including flutes, the flutes of the leg extending perpendicularly to the flutes of the deck panel.

4. A pallet according to claim 3, wherein the flutes in the deck panel extend parallel to the side edges, the flutes in the five panels forming the leg extending transversely across all of the five panels.

5. A pallet according to claim 4, including at least one flap connected by a fold line to each end edge of the deck panel, each flap of the deck panel being folded onto and fixed to a panel of one of the legs at the end edges of the deck panel.

6. A pallet according to claim 1, wherein each of the two side panels includes two side openings, one of the side panels including a pair of outer passage closing flaps, one for each side opening, and the other of said side panels includes a pair of inner passage closing flaps, one for each side opening.

7. A pallet according to claim 6, wherein each of said passage closing flaps includes a connected flap portion connected by a fold line to its respective side panel, an intermediate flap portion connected by a fold line to the connected flap portion, and a free flap portion connected by the fold line to the intermediate flap portion.

8. A pallet according to claim 7, wherein the passage through the quadrilateral shape, adjacent each side opening, is closed by an intermediate flap portion which spans the passage, each of the connected and free flap portions extending parallel to and lying against one of the side panels.

9. A pallet according to claim 1, wherein the five panels forming the leg comprise, in series, a lapping panel, a bottom panel connected by a fold line to the lapping panel, a first side panel connected by a fold line to the bottom panel, a top panel connected by a fold line to the first side panel and a second side panel connected by a fold line to the top panel, the lapping panel lapping and being connected to the second side panel in the quadrilateral shape of the leg.

10. A pallet according to claim 9, wherein each of the first and second side panels include a pair of side openings for dividing each of the first and second side panels into two outer and one intermediate panel portions, the lapping panel including two outer and one intermediate panel portions which are substantially the same length as the respective outer and intermediate panel portions of the side panels.

11. A pallet according to claim 10, wherein one pair of said end flaps is connected to the opposite ends of the bottom panel and the other pair of said end flaps is connected to the opposite ends of one of the side panels.

12. A pallet according to claim 11, including a pair of intermediate end flaps connected to opposite ends of the lapping panel by fold lines, the intermediate end flaps being folded and connected between the inner and outer end flaps.

13. A pallet according to claim 12, wherein the inner end flaps are connected to the opposite ends of the first side panel.

14. A pallet according to claim 13, wherein one of the first and second side panels includes a pair of outer passage closing flaps connected by fold lines to the side panel and the other of the first and second side panels include a pair of inner passage closing flaps connected by fold lines to the side panel, the passage closing flaps being formed by score lines for separating the flaps from the openings of the side panels.

15. A pallet according to claim 14, wherein the passage through the quadrilateral shape, adjacent each side opening, is closed by an intermediate flap portion which spans the passage, each of the connected and free flap portions extending parallel to and lying against one of the side panels.

16. A pallet according to claim 15, including at least one flap connected by a fold line to each end edge of the deck panel, each flap of the deck panel being folded onto and fixed to a side wall of one of the legs at the end edges of the deck panel.

17. A pallet according to claim 16, wherein the deck panel includes corrugated flutes extending parallel to one of the side and end edges, the five panels forming the leg including flutes, the flutes of the leg extending perpendicularly to the flute of the deck panel.

18. A pallet according to claim 17, wherein the flutes in the deck panel extend parallel to the side edges, the flutes in the five panels forming the leg extending transversely across all of the five panels.

19. A method of constructing a fiberboard pallet comprising:

providing a deck which includes a multi-wall corrugated fiberboard deck panel having opposite side edges, opposite end edges connected between said side edges, an upper surface and a lower surface;

providing a plurality of legs which each comprise five panels connected by fold lines to each other in series, the five panels being formed at the fold lines into an initially open-ended quadrilateral shape having a passage therethrough, one panel at one end of the series lapping another panel at an opposite end of the series, a pair of outer end flaps, connected at fold lines to outer ends of one of said five panels, a pair of inner end flaps connected at fold lines to opposite ends of another one said five panels, said inner end flaps being folded over respective ends of said open-ended quadrilateral shape, and said outer end flaps being folded over and fixed to said inner end flaps to close outer ends of the passage, two of said panels comprising side panels each having at least one side opening therethrough, said side openings being aligned in the quadrilateral shape, at least one of the side panels including a passage closing flap separated from the side opening of the side panel by score lines and connected to the side panel by at least one fold line, the passage closing flap being foldable into a position for closing the passage of the quadrilateral shape, adjacent the aligned side openings; and fixing each of the legs to the lower surface of the deck with at least two of the legs extending along and adjacent respective opposite end edges of the deck and at least one additional leg extending parallel to and between the at least two legs.

20. A method according to claim 1, including die cutting each of the series of five panels forming each leg.

21. A fiberboard blank for a fiberboard pallet leg, comprising:

five panels connected by fold lines to each other in series;

a pair of outer end flaps, connected at fold lines to opposite outer ends of one of said five panels;

a pair of inner end flaps connected at fold lines to opposite outer ends of another one said five panels, said inner and outer end flaps being foldable over respective ends of an open-ended quadrilateral shape which is formable by folding said panels along the fold lines therebetween, to close the ends of the quadrilateral shape;

two of said panels comprising side panels each having at least one side opening therethrough, said side openings being alignable in the quadrilateral shape; and at least one of the side panels including a passage closing flap separated from the side opening of the side panel by score lines and connected to the side panel by at least one fold line, the passage closing flap being foldable into a position for closing a passage through the quadrilateral shape, adjacent the aligned side openings, said passage closing flap includes a connected flap portion connected by a fold line to said at least one of the side panels for engaging an inner surface of said at least one of the side panels in the quadrilateral shape, an intermediate flap portion connected by a fold line to the connected flap portion, and a free flap portion connected by a fold line to the intermediate flap portion for engaging an inner surface of another side panel in the quadrilateral shape, the intermediate flap portion having a size so that the passage through the quadrilateral shape, adjacent each side opening, is closed to the intermediate flap portion which spans the passage when the passage closing flap is folded to close the passage through the quadrilateral shape.

22. A blank according to claim 21, wherein each of the two side panels includes two side openings, one of the side panels including a pair of outer passage closing flaps, one for each side opening, and the other of said side panels includes a pair of inner passage closing flaps, one for each side opening.

23. A blank according to claim 21, wherein the five panels comprise, in series, a lapping panel, a bottom panel connected by a fold line to the lapping panel, a first side panel connected by a fold line to the bottom panel, a top panel connected by a fold line to the first side panel and a second side panel connected by a fold line to the top panel, the lapping panel lapping and being connected to the second side panel in the quadrilateral shape of the leg.

24. A blank according to claim 23, wherein each of the first and second side panels include a pair of side openings for dividing each of the first and second side panels into two outer and one intermediate panel portions, the lapping panel including two outer and one intermediate panel portions which are substantially the same length as the respective outer and intermediate panel portions of the side panels.

25. A blank according to claim 24, wherein one pair of said end flaps is connected to the opposite ends of the bottom panel and the other pair of said end flaps is connected to opposite ends of one of the side panels.

26. A blank according to claim 25, including a pair of intermediate end flaps connected to opposite ends of the lapping panel by fold lines, the intermediate end flaps being foldable between the inner and outer end flaps.

* * * * *